US006671892B1

(12) United States Patent
Plyant

(10) Patent No.: US 6,671,892 B1
(45) Date of Patent: Jan. 6, 2004

(54) BIDET, DOUCHE AND ENEMA SYSTEM

(76) Inventor: Gary L. Plyant, 12448 N. 29th Ave., Phoenix, AZ (US) 85029

( * ) Notice: Subject to any disclaimer, the term of this patent is extended or adjusted under 35 U.S.C. 154(b) by 0 days.

(21) Appl. No.: 10/160,706

(22) Filed: May 31, 2002

Related U.S. Application Data

(60) Provisional application No. 60/295,458, filed on Jun. 1, 2001.

(51) Int. Cl.[7] ..... A47K 3/20

(52) U.S. Cl. ..... 4/420.4; 4/420.1; 4/445; 4/443

(58) Field of Search ..... 4/420.4, 420.1, 4/448, 447, 444, 443

(56) References Cited

U.S. PATENT DOCUMENTS 4,014,355 A * 3/1977 DiMatteo et al. ..... 134/30
4,062,072 A * 12/1977 Roberts ..... 4/420.4
4,259,754 A * 4/1981 Bader et al. ..... 4/443
4,383,339 A * 5/1983 Miller ..... 4/448
4,422,189 A * 12/1983 Couvrette ..... 4/420.2
4,581,779 A * 4/1986 Matsui et al. ..... 4/420.2
4,622,704 A * 11/1986 Chung ..... 4/443
5,272,774 A * 12/1993 Ivko et al. ..... 4/420.2
5,647,070 A * 7/1997 Yu ..... 4/420.4
5,893,177 A * 4/1999 Roemen et al. ..... 4/443

* cited by examiner

*Primary Examiner*—Gregory Huson
*Assistant Examiner*—Huyen Le
(74) *Attorney, Agent, or Firm*—Parsons&Goltry; Robert A. Parsons; Michael W. Goltry

(57) ABSTRACT

A bidet, douche and enema system including a supply line couplable to a water source, a manifold having an inlet coupled to the supply line by an inlet valve, a nozzle assembly coupled to the manifold by a first conduit and a second conduit and a selection assembly coupling the first conduit and the second conduit to the manifold. The nozzle assembly includes an annular nozzle having a plurality of apertures formed therein coupled to the first conduit and a nozzle coupled to the second conduit. The selection assembly permits selection between elements of the nozzle assembly.

18 Claims, 3 Drawing Sheets

BIDET, DOUCHE AND ENEMA SYSTEM

CROSS-REFERENCE TO RELATED APPLICATION

This application claims the benefit of U.S. Provisional Application Ser. No. 60/295,458, filed Jun. 01, 2001.

FIELD OF THE INVENTION

This invention relates to personal hygiene.

More particularly, the present invention relates to rectal and vaginal hygiene.

BACKGROUND OF THE INVENTION

In some cultures and parts of the world, bidets are common and often considered important. The provision of a bidet is often expensive and space consuming, as they are typically separate fixtures. Often, conventional bathrooms do not have the space for an additional fixture. Douches and enemas used for cleanliness and health reasons also require separate devices and are often very inconvenient to use. A complete cleaning of the colon is often impossible in home use devices, and only small quantities of fluid are employed, injected into the rectum to cause a bowel movement. The complete cleaning of the colon, generally requires professional assistance and devices. Given the foregoing, the current state of the art is characterized by disparate devices often unusable in the home environment to achieve the desired results.

It would be highly advantageous, therefore, to remedy the foregoing and other deficiencies inherent in the prior art.

Accordingly, it is an object of the present invention to provide a new and improved system incorporating a bidet, douche, and enema.

Another object of the invention is to provide a bidet, douche and enema system which is easy to use and can be employed in combination with a conventional toilet in the home environment.

Yet another object of the invention is to provide a enema system which will allow for substantial cleaning of the colon.

SUMMARY OF THE INVENTION

Briefly, to achieve the desired objects of the instant invention in accordance with a preferred embodiment thereof, provided is a bidet, douche and enema system including a supply line couplable to a water source, a manifold having an inlet coupled to the supply line by an inlet valve, a nozzle assembly coupled to the manifold by a first conduit and a second conduit and a selection assembly coupling the first conduit and the second conduit to the manifold. The nozzle assembly includes an annular nozzle having a plurality of apertures formed therein coupled to the first conduit and a nozzle coupled to the second conduit.

In a more specific aspect, the selection assembly includes a first outlet valve movable between an open position and a closed position, coupling the first conduit to a first outlet of the manifold, and a second outlet valve movable between an open position and a closed position, coupling the second conduit to a second outlet of the manifold. The nozzle assembly includes an annular nozzle having a plurality of apertures formed therein coupled to the first conduit and a nozzle coupled to the second conduit.

In another specific aspect of the invention, provided is a casing having a control portion receivable by a rim of a toilet bowl and an applicator portion extending from the control portion to a generally central position of the toilet bowl. The control portion carries the control assembly, and the applicator portion generally terminates in the nozzle assembly.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
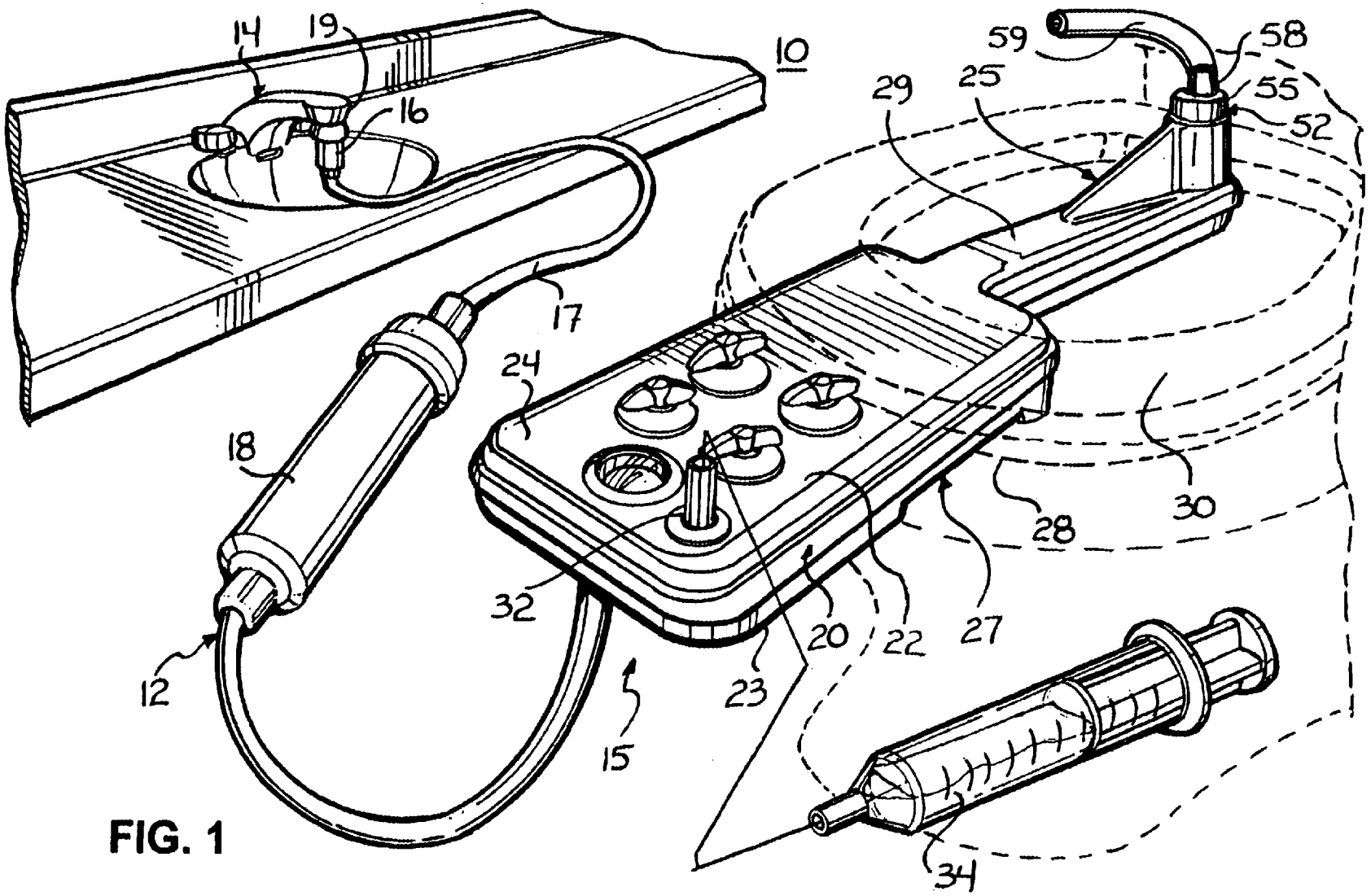
FIG. 1 is perspective view of a bidet, douche and enema system according to the present invention as it appears installed on a toilet.
Figure 4:
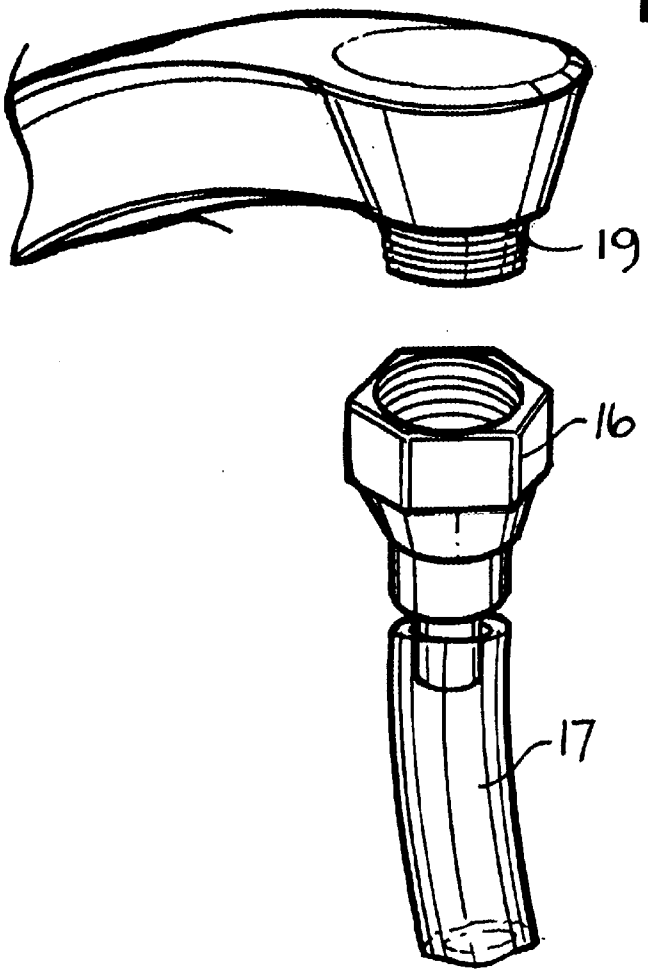
FIG. 4 is an enlarged perspective view of the water supply coupling of the system.

Turning now to the drawings in which like reference characters indicate corresponding elements throughout the several views, attention is first directed to FIG. 1 which illustrates a bidet, douche and enema system generally designated 10, according to the present invention. System 10 includes a supply line 12 removably coupled to a water source 14, and a control and application component 15. Supply line 12 includes a coupler 16, a supply conduit 17 and a filter 18. With additional, momentary reference to FIG. 4, coupler 16 couples one end of supply conduit 17 to water source 14, which in this preferred embodiment is a sink faucet. Coupler 16 can be any of a variety of couplers including screw on or quick release couplings. For example, a quick release fastener can include two portions, one installed on a faucet tap 19 and a complimental portion attached to the end of supply conduit 17. The portion on tap 19 can remain when the system is not in use. System 10 can then be quickly and easily coupled to water source 14 when desired. In the embodiment illustrated, coupler 16 has threads, and is simply threaded onto the threads of tap 19. The use of a conventional faucet allows for easy use in a home environment. The adequate supply of water further allows for the enema to substantially clean the colon, and not just for causing a bowel movement.

Filter 18 is carried by supply conduit 17 to remove impurities and chemicals such as chlorine from the water supplied by water source 14. While not necessary for some application, such as the bidet function, removal of impurities can be important for the douche and enema features as they may be harmful or at least reduce the benefits desired. Filter 18 can be substantially any filter that removes impurities from the water. It is also contemplated that the faucet may have a filter installed thereon.

Figure 2:
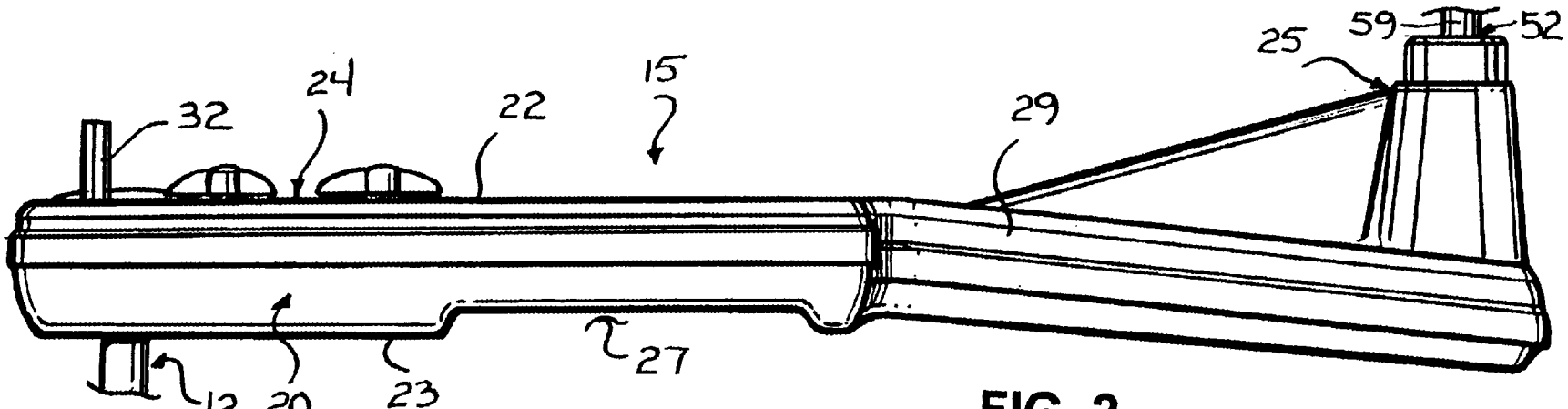
FIG. 2 is a side plan view of the control and application component of the system.

System 10 is intended to be installable on substantially any conventional toilet with ease and rapidity. Control and application component 15 includes an elongated casing 20 having 14 a top surface 22 and a bottom surface 23. Casing 20 is divided into a control portion 24 and an application portion 25. Control portion 24 has a channel 27 formed in bottom surface 23 of casing 20. When positioned properly on a toilet, the front portion of a toilet bowl 28 is received within channel 27. Application portion 25 extends from control portion 24 by a neck 29, terminating centrally within the toilet bowl, while control portion 24 extends outwardly from the front of bowl 28 allowing access by an individual. Component 15 is retained in position by lowering a toilet seat 30 across top surface 22 of casing 20. Casing 20 is preferably formed of injection molded plastic, but can be formed using other methods, such as vacuum formed plastic, or other materials. As can be seen with reference to FIG. 2, neck 29 is sloped downward so as to prevent fluids from running out of the bowl toward control portion 24.

Figure 5:
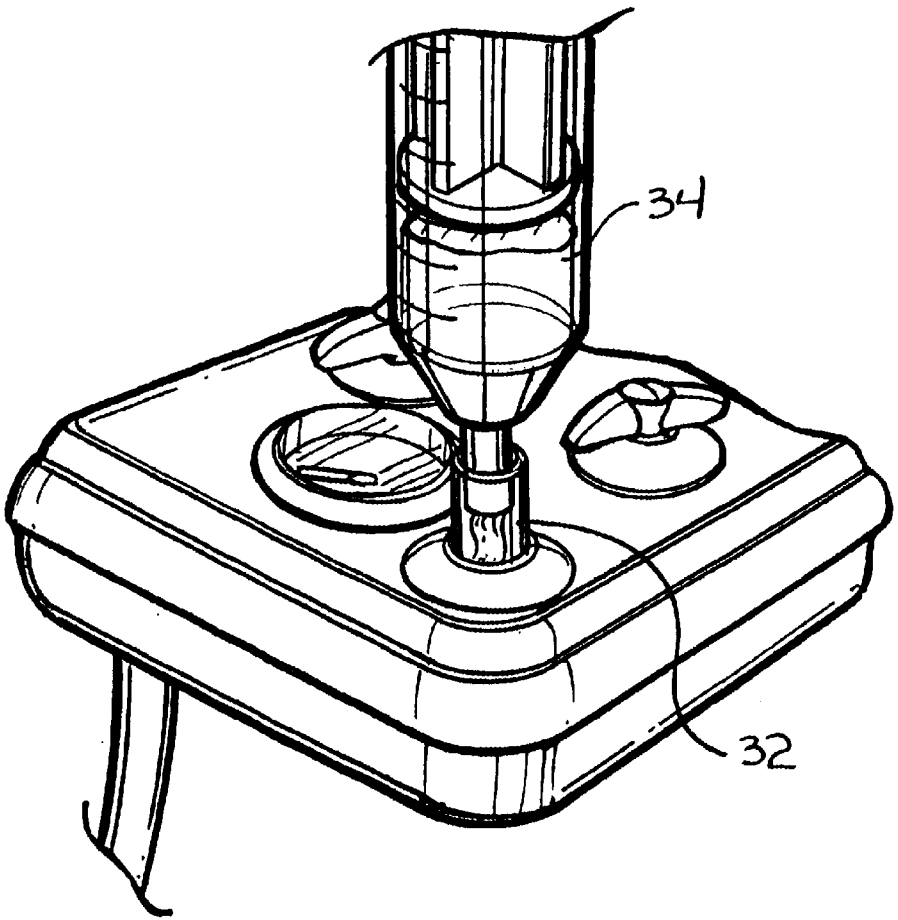
FIG. 5 is an enlarged perspective view of an additive inlet of the control and application component of the system.

Still referring to FIG. 1, with additional reference to FIG. 5, an additive inlet 32 is provided on control and application component 15 of system 10. Additive inlet 32 is coupled into system 10, as will be described presently, to permit douche and enema solutions to be injected into system 10. The solutions will not be itemized here as there are many such, well known in the art, and others being constantly developed. The solutions are injected into additive inlet 20 using a syringe 34 containing the desired solution of the appropriate volume.

Figure 3:
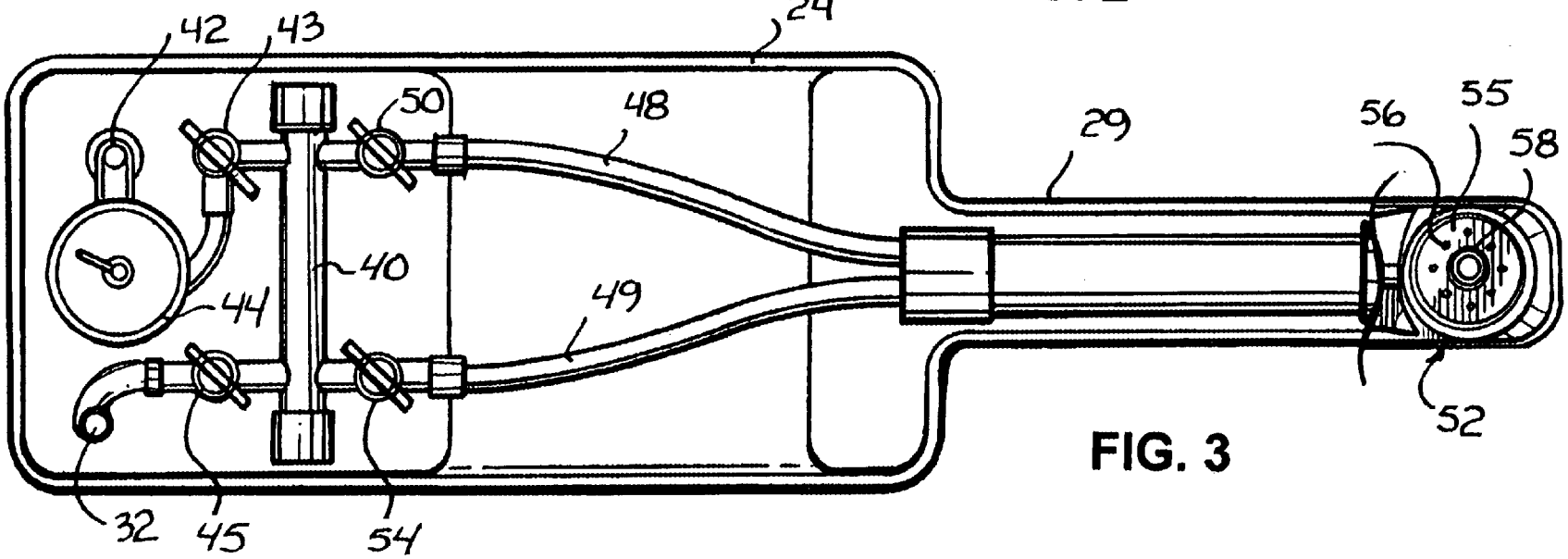
FIG. 3 is a top view of the control and application component of the system with a portion thereof removed to view the interior.

Turning now to FIG. 3, the inner workings of control and application component 15 are illustrated. Within case 20 is a control assembly including manifold 40 to which an inlet 42 is coupled. Supply conduit 17 is coupled to inlet 42, providing water to manifold 40. An inlet valve 43 having an open position and a closed position couples inlet 42 to manifold 40, allowing control of water from water source 14 to manifold 40. A temperature gauge 44, in this embodiment, is carried between inlet 42 and inlet valve 43 to monitor water temperature. Water temperature can be controlled at water source 14 (hot and cold faucet). It will be understood that the temperature gauge can also be positioned at any point along supply conduit 17.

Additive inlet 32 is coupled to an additive valve 45 having an open position and a closed position, allowing control of additive solutions into manifold 40. Typically, when additives are added, additive valve 45 is in the open position and inlet valve 43 is in the closed position. After the additive is inserted into system 10, additive valve 45 is moved to the closed position and inlet valve 43 is moved to the open position. Water, additive solutions or a combination of both can then move from the manifold to a bidet conduit 48 or douche/enema conduit 49.

Selection between conduits 48 and 49 is accomplished by using a selection assembly, which in this embodiment includes a plurality of valves. However, one skilled in the art will understand that the selection assembly can be a single valve having multiple selectable outlets. An end of bidet conduit 48 is coupled to manifold 40 by a bidet valve 50 movable between an open position allowing fluids from manifold 40 into conduit 48, and a closed position preventing fluids from manifold 40 into conduit 48. An opposing end of bidet conduit 48 extends from control portion 24 through neck 29 terminating in a nozzle assembly 52 at the terminus of neck 29. An end of douche/enema conduit 49 is coupled to manifold 40 by a douche/enema valve 54 movable between an open position allowing fluids from manifold 40 into conduit 49, and a closed position preventing fluids from manifold 40 into conduit 49. An opposing end of douche/enema conduit 49 extends from control portion 24 through neck 29 terminating in nozzle assembly 52.

Nozzle assembly 52 includes an annular nozzle 55 having a plurality of holes 56 therein. In this embodiment, eight holes are provided for the egress of water and solution, with four directed perpendicularly upward and four interspersed holes angled radially outwardly at approximately a two degree angle. Annular nozzle 55 is coupled to the opposing end of bidet conduit 48, and serves the function of a bidet. Nozzle assembly 52 also includes a nozzle 58 positioned within annular nozzle 55 and adapted to receive a disposable applicator 59 when the douche/enema function is desired. After use, the disposable applicator is removed from nozzle 58 and discarded. Applicator 59 is preferably a length of plastic tubing having an end receivable by nozzle 58 and a beveled end. Selection of the bidet or the douche/enema functions is achieved by moving bidet valve 50 to the closed position and douche/enema valve 54 to the open position or visa versa. Solution and/or water is provided by opening inlet valve 43 or additive valve 45 as desired.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same,

The invention claimed is:

1. A bidet, douche and enema system comprising:

a supply line couplable to a water source;

a manifold having an inlet coupled to the supply line by an inlet valve movable between an open position and a closed position;

an additive inlet coupled to the: manifold by an additive valve movable between an open position and a closed position;

a nozzle assembly coupled to the manifold by a first conduit and a second conduit; and a selection assembly coupling the first conduit and the second conduit to the manifold.

2. The system as claimed in claim 1 wherein the selection assembly comprises:

a first outlet valve movable between an open position and a closed position, coupling the first conduit to a first outlet of the manifold; and a second outlet valve movable between an open position and a closed position, coupling the second conduit to a second outlet of the manifold.

3. A system as claimed in claim 1 wherein the supply line comprises:

a supply conduit; and a coupler for coupling the supply line to a faucet.

4. A system as claimed in claim 3 wherein the supply line includes a filter.

5. A system as claimed in claim 3 wherein the supply line includes a temperature gauge.

6. A system as claimed in claim 1 wherein the nozzle comprises:

an annular nozzle having a plurality of apertures formed therein coupled to the first conduit; and a nozzle coupled to the second conduit.

7. A system as claimed in claim 6 wherein the nozzle a replaceable applicator.

8. A bidet, douche and enema system comprising:

a supply line couplable to a water source;

a manifold having an inlet coupled to the supply line by an inlet valve movable between an open position and a closed position;

a nozzle assembly coupled to the manifold by a first conduit and a second conduit;

a selection assembly coupling the first conduit and the second conduit to the manifold; and a casing having a control portion receivable by a rim of a toilet bowl and an applicator portion extending from the control portion to be positionable in a generally central position of the toilet bowl, the control portion carrying the selection assembly, and the applicator portion generally terminating in the nozzle assembly.

9. A bidet, douche and enema system comprising:

a supply line couplable to a water source;

a control assembly coupling the supply line to a nozzle assembly, the control assembly including a manifold having an inlet coupled to the supply line by an inlet valve movable between an open position and a closed position, a first conduit and a second conduit coupling the nozzle assembly to the manifold, and a selection assembly coupling the first conduit and the second conduit to the manifold; and a casing having a control portion receivable by a rim of a toilet bowl and an applicator portion extending from the control portion to be positionable in a generally central position of the toilet bowl, the control portion carrying the control assembly, and the applicator portion generally terminating in the nozzle assembly.

10. The system as claimed in claim 9 wherein the selection assembly comprises:

a first outlet valve movable between an open position and a closed position, coupling the first conduit to a first outlet of the manifold; and a second outlet valve movable between an open position and a closed position, coupling the second conduit to a second outlet of the manifold.

11. A system as claimed in claim 9 further including an additive inlet coupled to the manifold by an additive valve movable between an open position and a closed position.

12. A system as claimed in claim 9 wherein the supply line comprises:

a supply conduit; and a coupler for coupling the supply line to a faucet.

13. A system as claimed in claim 12 wherein the supply line further includes a filter.

14. A system as claimed in claim 12 wherein the supply line further includes a temperature gauge.

15. A system as claimed in claim 9 wherein the nozzle assembly comprises:

an annular nozzle having a plurality of apertures formed therein coupled to the first conduit; and a nozzle coupled to the second conduit.

16. A bidet, douche and enema system comprising:

a toilet bowl having a rim;

a supply line couplable to a water source;

a manifold having an inlet coupled to the supply line by an inlet valve movable between an open position and a closed position;

a nozzle assembly coupled to the manifold by a first conduit and a second conduit;

a selection assembly coupling the first conduit and the second conduit to the manifold; and a casing having a control portion received by a rim of a toilet bowl and an applicator portion extending from the control portion to a generally central position of the toilet bowl, the control portion carrying the control assembly, and the applicator portion generally terminating in the nozzle assembly.

17. The system as claimed in claim 16 wherein the selection assembly comprises:

a first outlet valve movable between an open position and a closed position, coupling the first conduit to a first outlet of the manifold; and a second outlet valve movable between an open position and a closed position, coupling the second conduit to a second outlet of the manifold.

18. A system as claimed in claim 17 wherein the nozzle assembly comprises:

an annular nozzle having a plurality of apertures formed therein coupled to the first conduit; and a nozzle coupled to the second conduit.

* * * * *

UNITED STATES PATENT AND TRADEMARK OFFICE

CERTIFICATE OF CORRECTION

PATENT NO. : 6,671,892 B1
DATED : January 6, 2004
INVENTOR(S) : Pylant, Gary L.

It is certified that error appears in the above-identified patent and that said Letters Patent is hereby corrected as shown below:

Column 4,
Line 61, insert -- includes -- in between “nozzle” and “a”.

Signed and Sealed this

Twenty-seventh Day of July, 2004

JON W. DUDAS
*Acting Director of the United States Patent and Trademark Office*